US009670755B1

(12) United States Patent
Lugo

(10) Patent No.: US 9,670,755 B1
(45) Date of Patent: Jun. 6, 2017

(54) PUMP MODULE SYSTEMS FOR PREVENTING OR REDUCING RELEASE OF HYDROCARBONS FROM A SUBSEA FORMATION

(75) Inventor: Mario R. Lugo, Houston, TX (US)

(73) Assignee: TRENDSETTER ENGINEERING, INC., Houston, TX (US)

( * ) Notice: Subject to any disclaimer, the term of this patent is extended or adjusted under 35 U.S.C. 154(b) by 189 days.

(21) Appl. No.: 13/360,990

(22) Filed: Jan. 30, 2012

Related U.S. Application Data

(63) Continuation-in-part of application No. 13/269,769, filed on Oct. 10, 2011, now Pat. No. 8,720,580, and a continuation-in-part of application No. 13/160,032, filed on Jun. 14, 2011.

(51) Int. Cl.
*E21B 33/064* (2006.01)
*E21B 43/01* (2006.01)

(52) U.S. Cl.
CPC ..... *E21B 43/0122* (2013.01); *E21B 33/064* (2013.01)

(58) Field of Classification Search
CPC .. E21B 33/035; E21B 43/0122; E21B 33/064; E21B 33/0355; E21B 33/06; E21B 34/04; E21B 33/038; E21B 33/043; E21B 23/00; E21B 33/076; E21B 19/16; E21B 33/03; E21B 33/068; E21B 41/04; E21B 43/013; E21B 21/00; E21B 21/001; E21B 21/08; E21B 43/128; E21B 27/00; E21B 33/00; E21B 33/061; E21B 33/062; E21B 34/063; E21B 43/00; E21B 43/0107; E21B 43/12
USPC ..... 166/338, 344, 347, 360, 363, 364, 368, 166/85.4
See application file for complete search history.

(56) References Cited

U.S. PATENT DOCUMENTS 1,635,749 A * 7/1927 Hosmer ..... E21B 33/06 166/85.4
3,032,106 A * 5/1962 Focht ..... E21B 19/002 166/341
3,155,175 A * 11/1964 Johnson ..... E21B 7/128 166/352
3,583,480 A * 6/1971 Regan ..... E21B 33/064 166/352
3,603,409 A * 9/1971 Watkins ..... E21B 7/128 166/352

(Continued)

*Primary Examiner* — Matthew R Buck
*Assistant Examiner* — Edwin Toledo-Duran
(74) *Attorney, Agent, or Firm* — Egbert Law Offices, PLLC

(57) ABSTRACT

A system for pumping a fluids from a subsea formation has a pipe extending into the formation, a first blowout preventer affixed to the pipe so as to be in fluid communication with the pipe, a flow diverter affixed to the first blowout preventer so as to have a diverter line in fluid communication with the flow passageway of the first blowout preventer, a pump module having a flow line affixed to the diverter line of the flow diverter so as to create a positive pressure to the fluid in the flow line, and an outline interconnected to the flow line of the pump module. The pump module is suitable for passing fluid from the flow line of the pump module through the outlet line. The pump produces a pressure to the fluid greater than the pressure of the formation. A second blowout preventer is affixed to the flow diverter.

10 Claims, 4 Drawing Sheets

(56) References Cited

U.S. PATENT DOCUMENTS 3,638,721 A * 2/1972 Harrison ..... E21B 33/085 166/351
4,036,295 A * 7/1977 Kirkland ..... E21B 43/013 166/342
4,063,602 A * 12/1977 Howell ..... E21B 7/128 175/48
4,147,221 A * 4/1979 Ilfrey ..... E21B 7/128 166/339
4,149,603 A * 4/1979 Arnold ..... E21B 7/128 166/368
4,283,159 A * 8/1981 Johnson ..... E21B 43/0122 166/364
4,318,442 A * 3/1982 Lunde ..... E21B 43/36 166/357
4,323,118 A * 4/1982 Bergmann ..... E21B 33/02 166/356
4,324,505 A 4/1982 Hammett
4,358,218 A * 11/1982 Graham ..... E21B 43/0122 210/922
4,405,258 A 9/1983 O'Rourke et al.
4,413,688 A * 11/1983 Seabourn ..... E21B 21/001 137/529
4,421,436 A * 12/1983 Burns ..... B63B 21/502 405/195.1
4,437,521 A * 3/1984 Richardson ..... E21B 41/06 166/341
4,444,250 A 4/1984 Keithahn et al.
4,444,401 A * 4/1984 Roche ..... E21B 21/001 166/363
4,456,071 A * 6/1984 Milgram ..... E21B 43/0122 166/356
4,502,534 A 3/1985 Roche et al.
4,527,632 A * 7/1985 Chaudot ..... B01D 19/0063 166/357
4,566,494 A * 1/1986 Roche ..... E21B 21/001 137/625.46
4,568,220 A * 2/1986 Hickey ..... E21B 43/0122 166/338
4,595,239 A * 6/1986 Ayler ..... E21B 35/00 299/2
4,601,608 A * 7/1986 Ahlstone ..... E21B 33/0355 166/344
4,611,661 A * 9/1986 Hed ..... E21B 33/035 166/339
4,625,806 A * 12/1986 Silcox ..... E21B 43/013 166/339
4,646,844 A 3/1987 Roche et al.
4,682,913 A * 7/1987 Shatto
4,688,633 A * 8/1987 Barkley ..... E21B 33/03 166/341
4,828,024 A 5/1989 Roche
4,832,126 A * 5/1989 Roche ..... E21B 21/001 137/114
5,199,496 A 4/1993 Redus et al.
5,323,860 A 6/1994 Watkins
5,971,077 A * 10/1999 Lilley ..... E21B 33/035 166/348
5,984,012 A 11/1999 Wactor et al.
6,015,013 A * 1/2000 Edwards ..... E21B 33/035 166/340
6,062,312 A * 5/2000 Wilkins ..... E21B 33/038 166/340
6,142,233 A * 11/2000 Wilkins ..... E21B 33/038 166/339
6,227,300 B1 * 5/2001 Cunningham ..... E21B 33/035 166/339
6,227,301 B1 * 5/2001 Edwards ..... E21B 33/035 166/344
6,230,824 B1 * 5/2001 Peterman ..... E21B 21/001 166/359
6,325,159 B1 * 12/2001 Peterman ..... E21B 21/001 166/350
6,352,114 B1 * 3/2002 Toalson ..... E21B 17/01 166/339
6,408,947 B1 * 6/2002 Cunningham ..... E21B 33/035 166/339
6,450,262 B1 * 9/2002 Regan ..... E21B 21/001 166/350
6,457,530 B1 * 10/2002 Lam ..... E21B 33/068 166/242.5
6,470,975 B1 * 10/2002 Bourgoyne ..... E21B 21/001 166/367
6,494,266 B2 * 12/2002 Rogala ..... E21B 33/0355 166/339
6,547,002 B1 * 4/2003 Bailey ..... E21B 33/085 166/383
6,615,921 B2 * 9/2003 Whitelaw ..... E21B 12/04 166/241.1
6,688,392 B2 2/2004 Shaw
6,715,554 B1 * 4/2004 Cunningham ..... E21B 33/035 166/348
7,080,685 B2 * 7/2006 Bailey ..... E21B 33/085 166/383
7,165,619 B2 1/2007 Fox et al.
7,216,714 B2 * 5/2007 Reynolds ..... E21B 33/035 137/557
7,222,674 B2 * 5/2007 Reynolds ..... E21B 33/035 166/341
7,308,954 B2 12/2007 Martin-Marshall
7,464,751 B1 * 12/2008 Abel ..... E21B 33/06 166/85.4
7,487,836 B2 * 2/2009 Boyce ..... E21B 19/002 166/338
7,597,811 B2 10/2009 Usher
7,669,649 B2 * 3/2010 Williams ..... E21B 33/085 166/84.3
7,726,418 B2 * 6/2010 Ayling ..... E21B 19/16 137/515
7,914,266 B2 3/2011 Kerr et al.
7,921,917 B2 * 4/2011 Kotrla ..... E21B 33/035 166/339
7,921,919 B2 * 4/2011 Horton ..... E21B 33/035 166/350
7,992,643 B2 * 8/2011 Donald ..... E21B 33/03 166/339
8,104,541 B2 * 1/2012 Donald ..... E21B 33/035 166/342
8,118,102 B2 * 2/2012 Robichaux ..... E21B 17/01 166/345
8,122,948 B2 * 2/2012 Donald ..... E21B 33/03 166/368
8,127,852 B2 * 3/2012 Judge ..... E21B 33/038 166/338
8,136,598 B2 * 3/2012 Kotrla ..... E21B 33/038 166/345
8,322,429 B2 * 12/2012 Judge ..... E21B 33/064 166/341
8,322,442 B2 * 12/2012 Voss ..... E21B 43/121 166/311
8,322,460 B2 * 12/2012 Horton, III ..... E21B 21/08 166/347
8,336,630 B2 * 12/2012 Kerr ..... E21B 34/045 166/340
8,434,557 B2 * 5/2013 Chaddick ..... F17D 1/00 166/344
8,434,558 B2 * 5/2013 Swanson ..... E21B 33/03 166/341
8,444,344 B2 * 5/2013 Oesterberg ..... E21B 43/0122 166/364
8,485,261 B2 * 7/2013 Botich ..... E21B 33/035 166/363
8,499,838 B2 * 8/2013 Fraser ..... E21B 33/038 166/338
8,511,387 B2 * 8/2013 Fraser ..... E21B 43/0122 166/338
8,544,535 B2 * 10/2013 Cote ..... E21B 33/03 166/368

(56) References Cited

U.S. PATENT DOCUMENTS 8,550,170 B2 * 10/2013 McHugh ..... E21B 33/037 166/264
8,622,139 B2 * 1/2014 Herbel ..... E21B 29/08 137/315.02
8,651,185 B2 * 2/2014 Hermes ..... E21B 33/02 166/286
2002/0100591 A1 * 8/2002 Barnett ..... E21B 33/076 166/345
2003/0170077 A1 * 9/2003 Herd ..... E21B 17/015 405/224.2
2003/0178200 A1 * 9/2003 Fox ..... E21B 7/124 166/341
2004/0031622 A1 * 2/2004 Butler ..... E21B 21/001 175/5
2006/0037782 A1 2/2006 Martin-Marshall
2009/0032264 A1 2/2009 Shepler
2009/0095464 A1 4/2009 McGrath et al.
2009/0260829 A1 10/2009 Mathis
2010/0071891 A1 * 3/2010 Liknes ..... E21B 43/127 166/77.4
2011/0100710 A1 * 5/2011 Fossli ..... E21B 21/001 175/7
2011/0274496 A1 * 11/2011 Dvorak ..... E21B 43/0122 405/64
2012/0018165 A1 * 1/2012 Crossley ..... E21B 33/037 166/344
2012/0048566 A1 * 3/2012 Coppedge ..... E21B 33/038 166/340
2012/0055680 A1 * 3/2012 Ibanez ..... E21B 43/0122 166/373
2012/0087729 A1 * 4/2012 Oesterberg ..... E21B 43/0122 405/60
2012/0090850 A1 * 4/2012 Botich ..... E21B 33/035 166/363
2012/0125623 A1 * 5/2012 Cargol, Jr. ..... E21B 43/0122 166/344
2012/0160509 A1 * 6/2012 Caldwell et al. ..... 166/363
2012/0211234 A1 * 8/2012 Wilie ..... E21B 43/0122 166/345
2012/0305258 A1 * 12/2012 Baugh ..... E21B 43/01 166/344
2012/0318516 A1 * 12/2012 Beynet ..... E21B 43/0122 166/344
2012/0318522 A1 * 12/2012 Franklin ..... E21B 43/0122 166/363
2013/0000919 A1 * 1/2013 Linderman ..... E21B 43/0122 166/344
2013/0008661 A1 * 1/2013 Hallundk ..... E21B 41/04 166/341
2013/0008665 A1 * 1/2013 Jelsma ..... E21B 43/0122 166/363
2013/0186688 A1 * 7/2013 Rasmus ..... E21B 47/06 175/48
2013/0299177 A1 * 11/2013 Lyle ..... E21B 33/064 166/338
2014/0027125 A1 * 1/2014 McHugh ..... E21B 33/037 166/351

* cited by examiner

PUMP MODULE SYSTEMS FOR PREVENTING OR REDUCING RELEASE OF HYDROCARBONS FROM A SUBSEA FORMATION

CROSS-REFERENCE TO RELATED APPLICATIONS

The present application is a continuation-in-part of U.S. patent application Ser. No. 13/269,769, filed on Oct. 10, 2011, and entitled "System and Method for Diverting Fluids from a Damaged Blowout Preventer", presently pending. U.S. patent application Ser. No. 13/269,769, is continuation-in-part of U.S. patent application Ser. No. 13/160,032, filed on Jun. 14, 2011, and entitled "Diverter System for a Subsea Well", presently pending.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to systems for diverting the flow of hydrocarbons from a blowout preventer. More particularly, the present invention the relates to pump modules associated with the flow of hydrocarbons from a subsea formation so as to prevent the release of hydrocarbons as a result of an underground blowout or as a result of damaged subsurface pipe. Additionally, the present invention relates to pump modules that can be utilized in association with a flow diverter of a blowout preventer.

2. Description of Related Art Including Information Disclosed Under 37 CFR 1.97 and 37 CFR 1.98.

As the worldwide demand for hydrocarbon fuel has increased, and known onshore reserves have not kept up with the demand, there has been increasing activity in offshore oil exploration and production. Reserves of oil known to exist in the offshore areas have steadily increased and an increasing percentage of the world production is from these offshore areas. The offshore environment has presented numerous new challenges to the oil drilling industry which have been steadily overcome to allow efficient drilling and production in these areas, although the costs have been considerably higher than those of onshore operations.

Not only has the offshore environment made production more difficult to accomplish, it has also generally increased the risk of environmental damage in the event of a well blowout or other uncontrolled loss of hydrocarbons into the sea. As a result, known safety equipment, such as blowout preventers, have been used in offshore operations. In spite of safety precautions, blowouts of offshore oil wells are known to occur and will occur in the future.

Subsea drilling operations may experience a blowout, which is an uncontrolled flow of formation fluids into the drilling well. These blowouts are dangerous and costly, and can cause loss of life, pollution, damage to drilling equipment, and loss of well production. To prevent blowouts, blowout prevention equipment is required. This blowout prevention equipment typically includes a series of equipment capable of safely isolating and controlling the formation pressures and fluids at the drilling site. The blowout preventer functions can include opening and closing hydraulically-operated pipe rams, annular seals, shear rams designed to cut the pipe, a series of remote-operated valves to allow control the flow of drilling fluids, and well re-entry equipment. In addition, process and condition monitoring devices complete the blowout preventer system. The drilling industry refers to the blowout preventer system as the blowout preventer stack.

The well and the BOP connect the surface drilling vessel to amarine riser pipe, which carries formation fluids (e.g., oil, etc.) to the surface and circulates drilling fluids. The marine riser pipe connects to the BOP through the Lower Main Riser Package (LMRP) which contains a device to connect to the BOP, an annular seal for well control, and flow control devices to supply hydraulic fluids for the operation of the BOP. The LMRP and the BOP are commonly referred to, collectively, as simply the BOP. Many BOP functions are hydraulically controlled, with piping attached to the riser supplying hydraulic fluids and other well control fluids. Typically, a central control unit allows an operator to monitor and control the BOP functions from the surface. The central control unit includes a hydraulic control system for controlling the various BOP functions, each of which has various flow control components upstream of it.

While many of the techniques used in onshore operations can be applied in the offshore environment, they often prove to be less effective and require a much longer time period for implementation. For example, while relief wells can be drilled to intercept the blowout well, a great amount of time may be required in the drilling operation. In drilling the relief wells, platforms or other drilling support decks must be located and transported to the blowout site before drilling operations can begin. Due to the rugged offshore environment, more time is required to drill the relief wells than would be required in onshore operations. As a result of all of these difficulties, many months can pass between the occurrence of an offshore oil well blowout and the successful final capping of the blown-out well. In the intervening time, large quantities of oil and gas can escape into the ocean with serious environmental impact.

While a portion of the hydrocarbons lost from a subsea well blowout may be trapped and skimmed by various containment booms and oil skimmer ships, substantial quantities of hydrocarbons can still escape such containment equipment. It can be seen that once the hydrocarbons are allowed to reach the ocean, surface wave action tends to disburse the lighter hydrocarbons which may mix with water or evaporate into the air. The gaseous hydrocarbons, of course, tend to escape into the atmosphere. The heavier ends of the crude oil often form into globules or tar balls which may flow at, or just below, the water's surface so as to make it difficult to contain or to skim up.

When high subsurface pressures are encountered, the excess pressure is diverted as a release into the water. Such hydrocarbon releases are extremely undesirable because of environmental consequences. Additionally, if such pressures are not released, it is possible that such high pressures could eventually cause a further subsea blowout of the subterranean formation at a location away from the well. Typically, these underground blowouts are a special situation where fluids from the high pressure zones flow uncontrolled to lower pressure zones within the wellbore. Usually, this occurs from deeper higher pressures zones to shallower low pressure formations. Underground blowouts can be very difficult to bring under control. If left unchecked, the fluids may find their way to the surface or from the ocean floor nearby. As such, it is extremely important to be able to effectively prevent the release of such fluids from such an underground blowout.

In the past, when a fracture in the subsea surface has occurred by way of an underground blowout, the only way to effectively prevent the release of hydrocarbons through such a fracture is by the drilling of a relief well in a location adjacent to the subsurface formation. The drilling of a relief well can be extremely time-consuming and difficult to establish. Certain relief wells may extend into a different formation and, as a result, be ineffective in preventing the release of hydrocarbons through such a fracture. In other circumstances, it will take a great deal of time for the relief well to effectively reduce the pressures within the subsea formation such that the release of hydrocarbons is prevented. As a result, it is important to provide a system whereby the release of hydrocarbons from such a fracture in the earth can be reduced or prevented by the use of equipment at the location of the subsurface formation.

Whenever high pressure hydrocarbons are released into subsea environments, a waste of the hydrocarbons will occur. If a substantial amount of hydrocarbons are released, then the production of such hydrocarbons is diminished. As a result, it is desirable to recapture that hydrocarbons and to avoid the release of such hydrocarbons into the subsea environments.

In past diversion systems, a variety of components are connected to a capping stack or a diverter system. These components involve the connection of various hoses to the subsea tree, to the subsea mandrel, or to other apparatus in the subsea environment. This is a very complicated and time-consuming procedure. Several ROVs would be required in order to complete such installations. The completion of such installations can be very difficult considering the nature of the blowout. The equipment often needs to be transported from remote locations in order to be effectively installed. As such, it is desirable to be able to provide a system whereby the equipment necessary for the capping of the damaged blowout preventer is easily made available in the location of the blowout.

In the past, various patents and patent publications have issued relating to systems for the containment of oil spills and blowouts. For example, U.S. Pat. No. 4,324,505, issued on Apr. 13, 1982 to D. S. Hammett, discloses a subsea blowout containment method and apparatus. This blowout containment apparatus comprises an inverted funnel adapted for positioning over a wellhead to receive fluids from the well and direct them into a conduit extending from the funnel to surface support and processing equipment. The funnel and conduit are supported from the sea's surface, preferably by a vessel, such as a barge. The barge carries the equipment to receive the full flow of fluids from the well, to process the fluids, and to conduct the liquids to a nearby tanker where the recovered liquid hydrocarbons may be stored.

U.S. Pat. No. 4,405,258, issued on Sep. 20, 1983 to O'Rourke et al., describes a method for containing oil and/or gas within a blow-out cover dome. This method includes the steps of deploying a containment dome in shallow water near the location of the seabed where the containment dome is to be located. The containment dome has an upper expanded dome-like fluid impervious membrane, a fluid impervious hollow peripheral ring attached to the periphery of the membrane to provide a depending bag-like container, and discrete water drainage means within the bag-like container for connection to pump conduit means therefrom. Wet sand from the seabed is then pumped into the bag-like container. Water is then drained from the wet sand through the water drainage means so as to provide a quantity of drained sand disposed within the bag-like container and providing a hollow peripheral ring as a hollow peripheral torus acting as a self-supporting structure and as an anchor for the dome-like structural unit. The dome is then charged with a buoyant amount of air and the buoyed dome is floated out to the site where the dome is to be deployed. It is then submerged by controllably releasing the air while substantially simultaneously filling the dome with water, thereby sinking the dome until the lighter-than-water fluid is captured within the dome.

U.S. Pat. No. 4,828,024, issued on May 9, 1989 to J. R. Roche, describes a diverter system and blowout preventer. The system comprises a blowout preventer attached above a spool having a hydraulically-driven sleeve/piston. An outlet flow passage exists in the spool. This outlet flow passage can be connected to a vent line. The outlet flow passage is closed off by the sleeve wall when the spool piston is at rest. Hydraulic ports are connected above and below the blowout preventer annular piston and above and below the spool annular piston. The ports below the blowout preventer piston and above the spool piston are in fluid communication with each other. A hydraulic circuit is provided having two valves between a source of pressurized hydraulic fluid and a drain.

U.S. Pat. No. 5,984,012, issued on Nov. 16, 1999 to Wactor et al., provides an emergency recovery system for use in a subsea environment. This emergency recovery system has a casing that is open at each end with a shackle connected to one end of the casing with the opposite end of the shackle designed for connection to appropriate points on the main stack and lower marine riser package in any orientation. A flexible sling with a closed loop formed at each end is used with one of the closed loops releasably connected to the shackle and the end of the casing. The other end of the sling has a flotation member attached to the sling adjacent the closed loop. The sling is fan folded as it is lowered into the casing. The flotation member is shaped to fit inside the other end of the casing with the closed end loop of the sling protruding from the casing. The flotation member is constructed of synthetic foam and is sized to provide sufficient buoyancy to fully extend the sling when the release ring is released by a remotely-operated vehicle in a subsea environment.

U.S. Pat. No. 7,165,619, issued on Jan. 23, 2007 to Fox et al., teaches a subsea intervention system that includes a BOP module and CT module. A tool positioning system is used for positioning a selected subsea tool stored within a rack with a tool axis in line with the BOP axis, while a coiled string injector is moved by a positioning system to an inactive position. Power to the subsea electric motors is supplied by an electrical line umbilical extending from the surface for powering the pumps. An injector is provided that includes a pressure compensator roller bearing and a pressure-compensated drive system case.

U.S. Pat. No. 7,597,811, issued on Oct. 6, 2009 to D. Usher, provides a method and apparatus for subsurface oil recovery using a submersible unit. The submersible vehicle is positioned above the bed of a diver supported on a platform above the pollutant. A wand at one end of a pipe evacuated by a centrifugal pump is manipulated to draw the pollutant to the surface for treatment or disposal.

U.S. Pat. No. 7,921,917, issued on Apr. 12, 2011 to Kotrla et al., shows a multi-deployable subsea stack system. This subsea stack system includes a lower marine riser package, a blowout preventer stack with a first ram blowout preventer, and an additional blowout preventer package releasably coupled to the blowout preventer stack and comprising a second ram blowout preventer. The subsea blowout preventer stack assembly can be deployed by coupling a drilling riser to the lower marine riser package that is releasably connected to the blowout preventer stack. The lower marine riser package and blowout preventer stack are then attached to a subsea wellhead and then landed on the additional blowout preventer package that is coupled to the subsea wellhead.

U.S. Patent Publication No. 2009/0095464, published on Apr. 16, 2009 to McGrath et al., provides a system and method for providing additional blowout preventer control redundancy. This system has backup or alternate fluid flow routes around malfunctioning BOP control components using a remotely-installed removable hydraulic hose connection. The backup fluid flow route sends pressure-regulated hydraulic fluid to a BOP operation via an isolation valve rigidly attached to the BOP, then to a hose connected to an intervention panel on the BOP, and finally through a valve that isolates the primary flow route and establishes a secondary flow route to allow continued operation.

U.S. Patent Publication No. 2009/0260829, published on Oct. 22, 2009 to D. J. Mathis, provides a subsea tree safety control system that limits the probability of failure on demand of a subsea test tree. A safety shut-in system is provided for actuating a safety valve of the subsea test tree. The safety shut-in system includes a surface control station positioned above a water surface connected via an umbilical to a subsea control system positioned below the water surface so as to actuate the safety valve.

U.S. Pat. No. 4,444,250, issued on Apr. 24, 1984 to Keithahn et al., teaches a flow diverter apparatus having a housing and a piston with an annular packer disposed therein. The diverter has passages in the piston and housing walls providing fluid communication between the borehole and a vent line. A valve in the vent line is opened before the packer of the apparatus is closed about a tubular member in the bore or completely closes the vertical flow path of the bore. This diverts pressurized borehole fluid away from the rig equipment and personnel.

U.S. Pat. No. 4,502,534, issued on Mar. 5, 1985 to Roche et al., describes a flow diverter for connection to a drilling conduit beneath a drilling rig floor for diverting pressurized wellbore fluid in the conduit from the rig and sealing the annulus between a pipe or other object and the conduit or closing the vertical flow path of the conduit. The apparatus has a housing, and annular packing element and two pistons. The housing is provided with at least one outlet passage in the wall of its body. One of the two pistons acts as a sliding sleeve valve in cooperation with the housing wall for preventing fluid communication between the outlet passage and the interior of the housing when it is in a nonactuated or normal position and for allowing fluid communication when it is in an actuated or diverting position.

U.S. Pat. No. 4,646,844, issued on Mar. 3, 1987 to Roche et al., shows a diverter/BOP system and method for a bottom-supported offshore drilling rig. The system includes a fluid flow controller and at least two bases adapted for being alternatively removably secured to the controller. When the first base is in combination with the fluid flow controller, the system may be used only as a diverter and when the second base is used in combination with the fluid flow controller the system may be used only as a blowout preventer.

U.S. Pat. No. 5,323,860, issued on Jun. 28, 1994 to B. J. Watkins, describes an apparatus for connecting a diverter assembly to a blowout preventer stack. An upper tubular member is adapted to be connected to the diverter assembly to form a lower continuation of the lower end of its bore. A lower tubular member is adapted to be connected to the blowout preventer stack to form an upper continuation of the upper end of its bore. A tubular body extends between and is pivotally and sealably connected to the upper and lower tubular members to connect their bores.

U.S. Pat. No. 6,230,824, issued on May 15, 2001 to Peterman et al., teaches a rotating subsea diverter for isolating fluid in a well from other fluid above the well. The rotating diverter includes a housing body which has a bore running through it. A retrievable spindle assembly includes a spindle and a bearing assembly that is disposed in the bore. The bearing assembly supports the spindle for rotation. The spindle is adapted to receive and seal around a tubular member. The rotation of the tubular member rotates the spindle within the bore.

U.S. Pat. No. 7,308,954, issued on Dec. 18, 2007 to P. S. Martin-Marshall, shows a rotating diverter head for use on a blowout preventer stack of an oil well. The head provides for sealing and rotation of a drill pipe through the head and includes a flange on which the head is rotatable. The flange connects the head to the stack whereupon it can be rotated to align a return flow line before being locked in position.

U.S. Patent Publication No. 2006/0037782, published on Feb. 23, 2006 to P. S. Martin-Marshall, describes a monitoring system for a rotating diverter head for use in an oil well. The system includes a pressure sensor which is mounted beside the stripper rubber which contacts the drill pipe. An increase in the pressure monitored provides early warning of degradation or imminent failure of the seal.

In the past, various types of pumping apparatus have been provided for the reduction of wellhead pressures. For example, U.S. Pat. No. 5,199,496, issued on Apr. 6, 1993 to Redus et al., describes a subsea pumping device incorporating a wellhead aspirator. This system utilizes the Bernoulli effect such that a head is delivered to the flowing stream that enables the crude oil/water/gas fluid within the system to be moved farther distances than wellhead pressure alone would allow.

U.S. Pat. No. 6,688,392, issued on Feb. 10, 2004 to C. K. Shaw, describes a system and method for flow/pressure boosting in a subsea environment. This is a system for producing hydrocarbon fluids from a subsea formation that includes at least one producing well penetrating the formation for producing hydrocarbon fluids. At least one dummy well is hydraulically connected to the producing well for routing the hydrocarbon fluids from the producing well to the dummy well. At least one pump is disposed in the dummy well. The pump takes suction flow from the dummy well and boosts the flow energy of the discharge flow of hydrocarbon fluids.

U.S. Pat. No. 7,914,266, issued on Mar. 29, 2011 to Kerr et al., describes a submersible pumping system and method for boosting subsea production flow. The booster pumping system includes a submersible pump hydraulically connected to the production well to provide energy to the hydrocarbon flow and boost production to another destination, such as a subsea production facility, or to the surface by way of a riser. An inlet conduit to receives the flow from the production well and isolates the flow from the dummy wellbore and direct the flow to the intake of the pump. A motor exposed to the dummy wellbore serves to drive the pump. The dummy wellbore can be flooded or circulated with seawater to cool the motor.

U.S. Patent Publication No. 2009/0032264, published on Feb. 5, 2009 to R. A. Shepler, describes a pumping system for producing hydrocarbons from a subsea production well which utilizes at least one electrical submersible pumping system hydraulically connected to at least one multiphase pump.

It is an object of the present invention to prevent a release of hydrocarbons as a result of an underground blowout.

It is another object of the present invention to provide a system for reducing the release of hydrocarbons that is the result of a damaged or broken subsea pipe.

It is a further object of the present invention to provide a system for reducing the release of hydrocarbons which can be easily and conveniently interconnected to the existing blowout preventer.

It is still a further object of the present invention to provide a system that can be utilized in association with a damaged blowout preventer so as to divert fluids therefrom and for the purpose of reducing the formation pressures in order to reduce the release of hydrocarbons from the formation.

It is another object of the present invention to provide a system and process that can recover substantially all of the fluids from the blowout preventer and for preventing the mixing of such fluids with seawater.

It is another object of the present invention to provide a system and process whereby high pressure fluids from the subsea well can be effectively contained and/or transported to the surface.

It is still another object of the present invention to provide a system and process which avoids the need for connecting hoses, manifolds, and other subsea equipment to the diverter.

It is still a further object of the present invention to provide a system and process that effectively utilizes equipment located in the vicinity of the damaged blowout preventer.

It is still a further object of the present invention to provide a system and process whereby high pressure fluids up to 15,000 p.s.i. can be effectively managed and contained.

It is still another object of the present invention to provide a system and process whereby the equipment used for the capping of a damaged blowout preventer can easily be installed with conventional equipment.

These and other objects and advantages of the present invention will become apparent from a reading of the attached specification and appended claims.

BRIEF SUMMARY OF THE INVENTION

The present invention is a system for pumping a fluid from a subsea formation. The system comprises a pipe extending into the subsea formation, a first blowout preventer affixed to the pipe, a flow diverter affixed to the first blowout preventer, a pump module having a flow line affixed to the diverter line of the flow diverter, and an outlet line interconnected to a flow line of the pump module. The blowout preventer has a flow passageway therein. The flow passageway is in fluid communication with the pipe. The flow passageway has the diverter line in fluid communication with the flow passageway of the first blowout preventer. The pump module is cooperative with the diverter line of the flow diverter so as to create a positive pressure to the fluid in the flow line. The pump module is suitable for pumping the fluid from the flow line of the pump module through the outlet line.

A second blowout preventer can be affixed to the flow diverter. The flow line of the pump module is in fluid communication with a flow passageway of the second blowout preventer. The outlet line communicates with the flow passageway of the second blowout preventer. The outlet line is a choke-and-kill line connected to the second blowout preventer.

The pump module of the present invention includes a frame, a pump affixed to the frame, and a motor operatively connected to the pump so as to drive the pump. A connector is affixed to the flow line of the pump module. The connector is connected to the diverter line of the flow diverter The motor is a hydraulic motor. A hydraulic line is affixed to the hydraulic motor so as to pass a liquid through the hydraulic motor so as to drive the motor.

The flow diverter has a guide funnel at an upper end thereof. The pump module has a guide post slidably received in the guide funnel of the flow diverter so as to align the flow line of the pump module with the diverter line of the flow diverter. In particular, the guide funnel of the flow diverter comprises a first guide funnel and a second guide funnel in spaced relation to the first guide funnel. The guide post of the pump module includes a first guide post received in the first guide funnel and a second guide post received in the second guide funnel. The first guide post has a length shorter than a length of the second guide post.

In the present invention, the subsea formation will have a fluid pressure. The pump module creates a positive pressure greater than the fluid pressure of the subsea formation. As a result, since the pressure created by the pump module is greater than the pressure of the subsea formation, a negative pressure will created within the subsea formation such that flow through any fracture caused by an underground blowout is diverted from such fracture so as to flow directly through the system of the present invention. As a result, the release of hydrocarbons as a result of such underground blowouts is significantly reduced and/or prevented.

The present invention is also a pumping apparatus for use with a blowout preventer. This pump module includes a frame, a pump affixed to the frame, a motor operatively connected to the pump so as to drive the pump, and a connector affixed to the inlet line of the pump. The connector is suitable for connection to a diverter line extending from the blowout preventer.

A mandrel is affixed to the frame and extends upwardly therefrom. The mandrel is suitable for connection to a flow passageway thereabove. The outlet line is in fluid communication with an interior of the mandrel so as to pass the fluid under pressure to the flow passageway. The pump generates a fluid pressure greater than the fluid pressure of the subsea formation. The pump is a hydraulic motor. This hydraulic motor has a liquid inlet extending therefrom.

A first guide post is affixed to the frame and extends downwardly therefrom. A second guide post is also affixed to the frame and extends downwardly therefrom in spaced, generally parallel relationship to that of the first guide post. The first guide post has a length that is shorter than the length of the second guide post.

The present invention is also a process for reducing a release of hydrocarbons from a subsea formation. This process includes the steps of: (1) affixing a flow diverter to a flow passageway of the blowout preventer so as to pass the hydrocarbons from the blowout preventer through a diverter line of the flow diverter; (2) pumping the hydrocarbons outwardly of the diverter line at a pressure greater than the pressure of the subsea formation; and (3) passing the pumped hydrocarbons through an outlet line to a remote location.

In particular, the process of the present invention further includes connecting a choke-and-kill line to the outlet line. This choke-and-kill line has a first passageway for passing the passed pumped hydrocarbons to the remote location and a second passageway for passing a liquid downwardly therethrough. The step of pumping further includes driving a pump with a motor so as to pump the hydrocarbons upwardly, and delivering the liquid through the second passageway of the choke-and-kill line so as to drive the motor. Another blowout preventer is connected to the outlet line. The choke-and-kill line is connected to this another blowout preventer. A ram of this another blowout preventer is closed such that the hydrocarbons flow through the first passageway of the choke-and-kill line and such that the liquid flows downwardly through the second passageway to the motor.

The foregoing Summary of the Invention is included herein so as to identify the nature of the preferred embodiment of the present invention. It is understood that this Summary of the Invention is not intended, in any way, to limit the scope of the present invention. The scope of the present invention should only be limited by the attached claims and their legal equivalents.

DETAILED DESCRIPTION OF THE INVENTION

Figure 1:
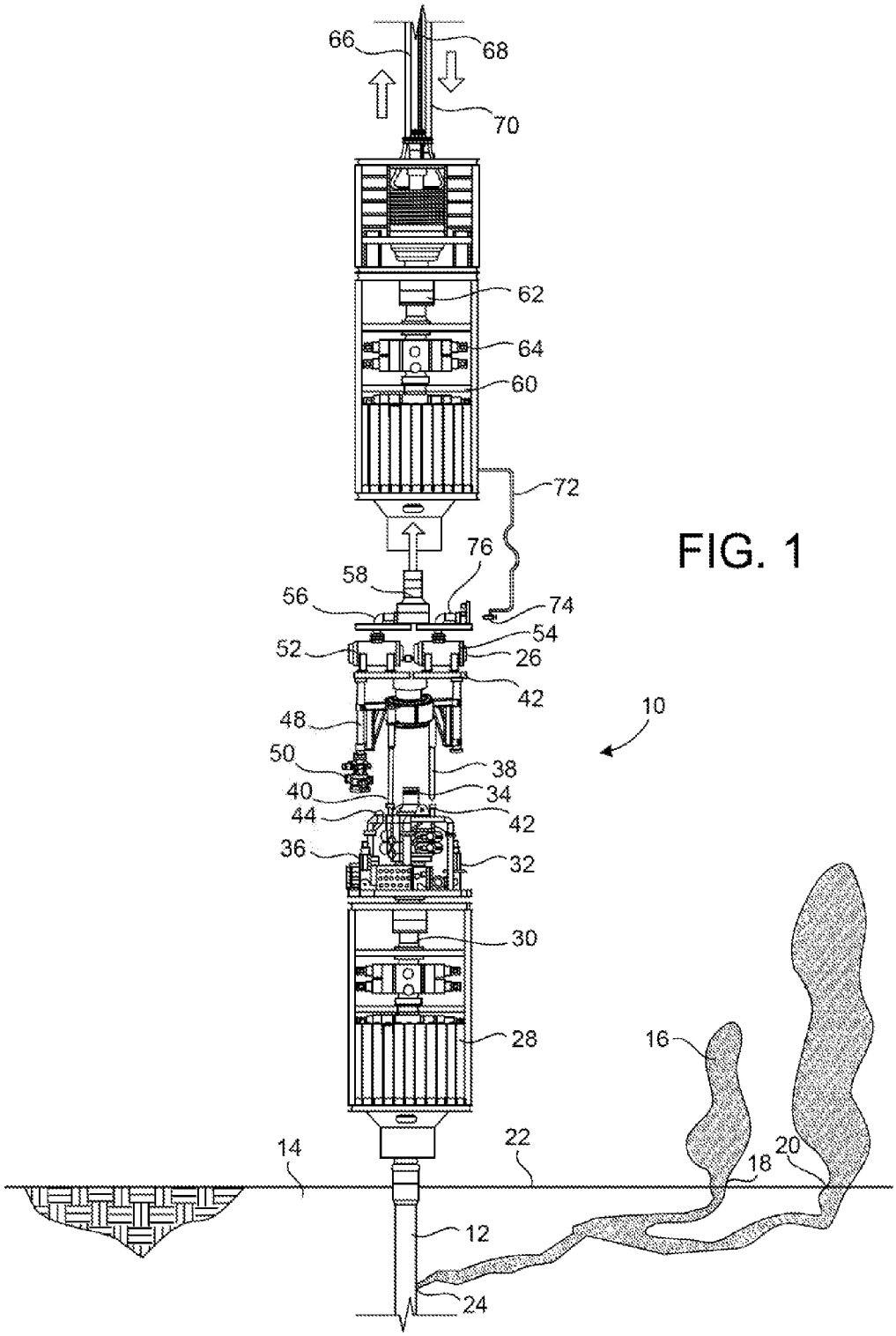
FIG. 1 is a side elelvational view of the system of the present invention as applied to an underground blowout associated with a subsea formation.

Referring to FIG. 1, there is shown the system 10 for the reduction of the release of hydrocarbons from a subsea formation. In particular, the system 10 is utilized in association with a pipe 12 extending into the subsea formation 14. The subsea formation is illustrated as experiencing an underground blowout such that the hydrocarbons 16 are being released through fractures 18 and 20 on the surface 22 of the subsea formation 14.

It should be noted that the fractures 18 and 20 can occur through a variety of circumstances. In particular, in FIG. 10, it can be seen that the pipe 12 has deteriorated so that a break 24 has occurred in the pipe. This break 24 is located generally adjacent to the surface 22 of the subsea formation 14. As a result, the hydrocarbons that would normally be passing through the pipe 12 are released adjacent to the surface 22 and will flow so as to be released outwardly through the breaks 18 and 20. In other circumstances, a build-up of pressures in the subsea formation can occur adjacent to the surface 22 so as to create the fractures 18 and 20 for the release of the hydrocarbons 16. The release of hydrocarbons 16 is the result of the pressure of the pressure of the hydrocarbons within the subsea formation 14 being greater than the pressure of the fluid passing through the pipe 12. Within the concept of the present invention, it is understood that if the pressure of the fluid passing through the pipe were greater than that of the pressure within the subsea formation 14, then such fractures 18 and 20 would not occur and the release of the hydrocarbons 16 would not occur. As such, the present invention utilizes a pumping module 26 which serves to avoid such a release.

In FIG. 1, a first blowout preventer 28 is affixed to the pipe 12. The first blowout preventer 28 has a flow passageway 30 therein. This flow passageway 30 will be in fluid communication with the pipe 12.

Under certain circumstances, the blowout preventer 28 may fail. If the blowout preventer 28 would fail, then the release of the hydrocarbons 16 could also occur. As such, it is necessary to incorporate a capping stack 32 onto the top of the first blowout preventer 28 so as to avoid the release of the hydrocarbons. The capping stack 32 is in the nature of the capping stack that was described in U.S. patent application Ser. No. 13/160,032 by the present inventor. Fundamentally, the capping stack 32 has a mandrel that is affixed to the top of the blowout preventer 28. When the capping stack 32 is installed, the flow passageway within the capping stack 32 will be opened so that hydrocarbons can flow from the blowout preventer 28 through the flow passageway 30 and outwardly through the flow passageway 34 of the capping stack 32. Once the capping stack 32 is properly installed, suitable valves associated with the flow passageway 34 can be closed so as to prevent the flow of the hydrocarbons through this flow passageway 34. Ultimately, this flow is diverted through a diverter line 36 of the capping stack 32 so that the hydrocarbons can be released in a controlled manner. The controls of the capping stack (or flow diverter) 32 can be manipulated remotely or by an ROV.

The pump module 26 has posts 38 and 40 extending downwardly from a frame 42. Post 38 has a length that is shorter than the length of the post 40. The post 38 is received within a funnel 42 at the top of the capping stack 32. The post 40 is received within the funnel 44 at the top of the capping stack 32. As such, the alignment of the posts 38 and 40 with the respective funnels 42 and 44 will assure the proper alignment of the pump module 26 with the capping stack 32.

The pump module 26 has a flow line 48 that has a connector 50 at a bottom thereof. Flow line 48 and connector 50 are suitable for joining with the diverter line 36 of the capping stack 32. As such, fluids flowing through the diverter line 36 can pass into the flow line 48. A pump 52 is affixed to the frame 42 of the pump module 26. The pump 52 is driven by a motor 54. Motor 54 is also affixed to the frame 42 of the pump module 26. Pump 52 is a high pressure pump that is capable of generating pressures greater than the pressures of the fluid within the subsea formation 14. The pump 52 has an outlet line 56 that extends upwardly therefrom. Outlet line 52 is in fluid communication with the interior of a mandrel 58 at the top of the pump module 26. As such, the flow of hydrocarbons from the pipe 12 will pass through the flow passageway 30 of the first blowout preventer 28, through the diverter line 36 of the capping stack 32, through the flow line 48 of the pump module 26, and outwardly from the outlet line 56 to the interior of the mandrel 58.

A second blowout preventer 60 has a bottom that is connected to the mandrel 58 of the pump module 26. The second blowout preventer 60 can be a functional blowout preventer. This blowout preventer can be readily made available at the site of the underground blowout. Once the second blowout preventer 60 is installed upon the mandrel 58 to the pump module 26, the hydrocarbons will flow the interior passageway 62 thereof. Suitable rams 64 can be closed in relation to the flow passageway 62 of the second blowout preventer 60 so as to divert the flow to a choke line 66 associated with the drill string. As such, the flow of hydrocarbons will flow to the surface by way of the choke line 68.

In the present invention, a suitable liquid can flow through a kill line 70 back down toward the second blowout preventer 60. This liquid will pass through the kill line 70 and outwardly through a conduit 72 extending outwardly of the second blowout preventer 60. Conduit 62 can have a hot stab 74 thereon so as to allow an ROV to install the conduit 72 into the inlet 76 associated with the motor 54. As a result, the liquid passing through the inlet 76 can be used so as to drive the hydraulic motor. Hydraulic motor is coupled to the pump 52 so as to drive pump 52 at the desired rate so as to achieve the desired pump pressures.

Since the pressures generated by pump 52 will be greater than the formation pressures within the subsea formation 14, the hydrocarbons 16 will flow through the break 24 in the pipe 12 back into the interior of the pipe 12. As a result of this negative pressure affecting the subsea formation 14, the flow of hydrocarbons 16 through the fractures 18 and 20 is significantly reduced and/or prevented.

Figure 2:
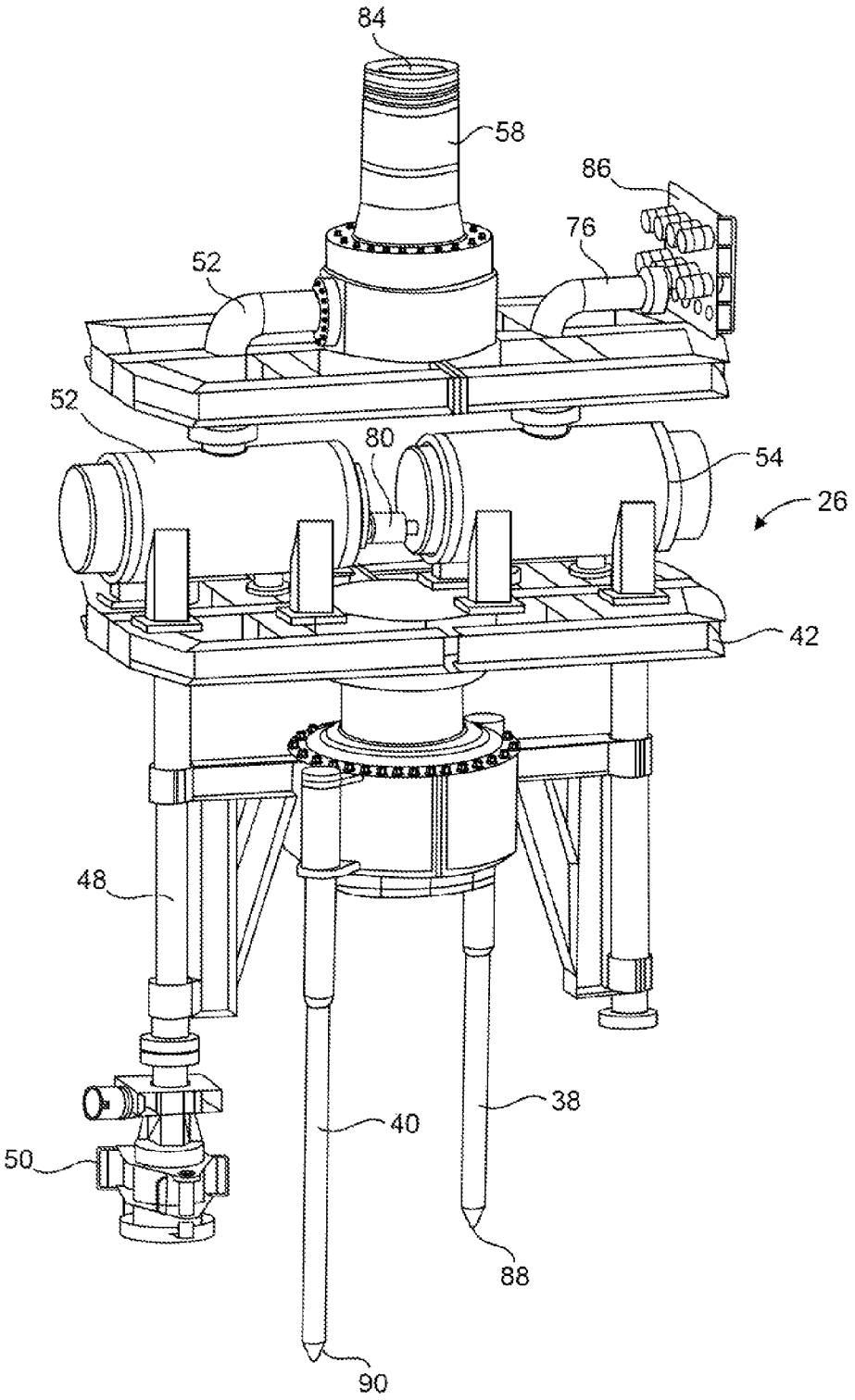
FIG. 2 is a perspective view of the pump module as used in the system of the present invention.

FIG. 2 is an isolated view of the pump module 26. The pump module 26 includes the frame 42. The motor 54 is affixed to the frame 42. A coupler 80 joins the drive shaft of the motor 54 with the pump 52. As a result, the motor 54 is effectively able to drive the pump 52. The flow line 48 extends upwardly from the connector 50. Connector 50 has a mechanism so as to automatically couple the connector 50 with the outlet of the diverter line 36 associated with the capping stack 32. The pump 52 will create a suitable positive pressure upon the fluid within the flow line 48 so as to pass the pressurized fluid upwardly through the outlet line 56 and into the interior 84 of the mandrel 58. The inlet line 76 is illustrated as having a control panel affixed thereto. Control panel 86 allows for remote operation of the controls necessary for the flow of the liquid from the kill line 70 and the conduit 72 into the inlet line 76. Inlet line 76 is connected to the hydraulic motor 54 so as to drive the hydraulic motor.

The frame 42 has a first guide post 38 and the second guide post 40 extending downwardly therefrom. First guide post 38 is spaced parallel relationship to the second guide post 40. The respective ends 88 and 90 of the guide posts 38 and 40 are suitably pointed so as to allow for easy installation within the respective funnels 42 and 44 of the capping stack 32. The first guide post 38 has a length that is shorter than the second guide post 40.

Since each of the flow lines 48 and the outlet line 52 of the pump module 26 is of structurally sound piping (as opposed to hoses), the significant pressures with the pumping hydrocarbons can be effectively accommodated. Typically, prior art hoses are not able to withstand the high formation pressures associated with the subsea formation 14. This hard piping allows such pressurized fluid to be properly passed by the pump 52. As a result, the pump module 26 is able to withstand the high pressures (up to 15,000 p.s.i.) associated with the fluid that is being delivered.

Figure 3:
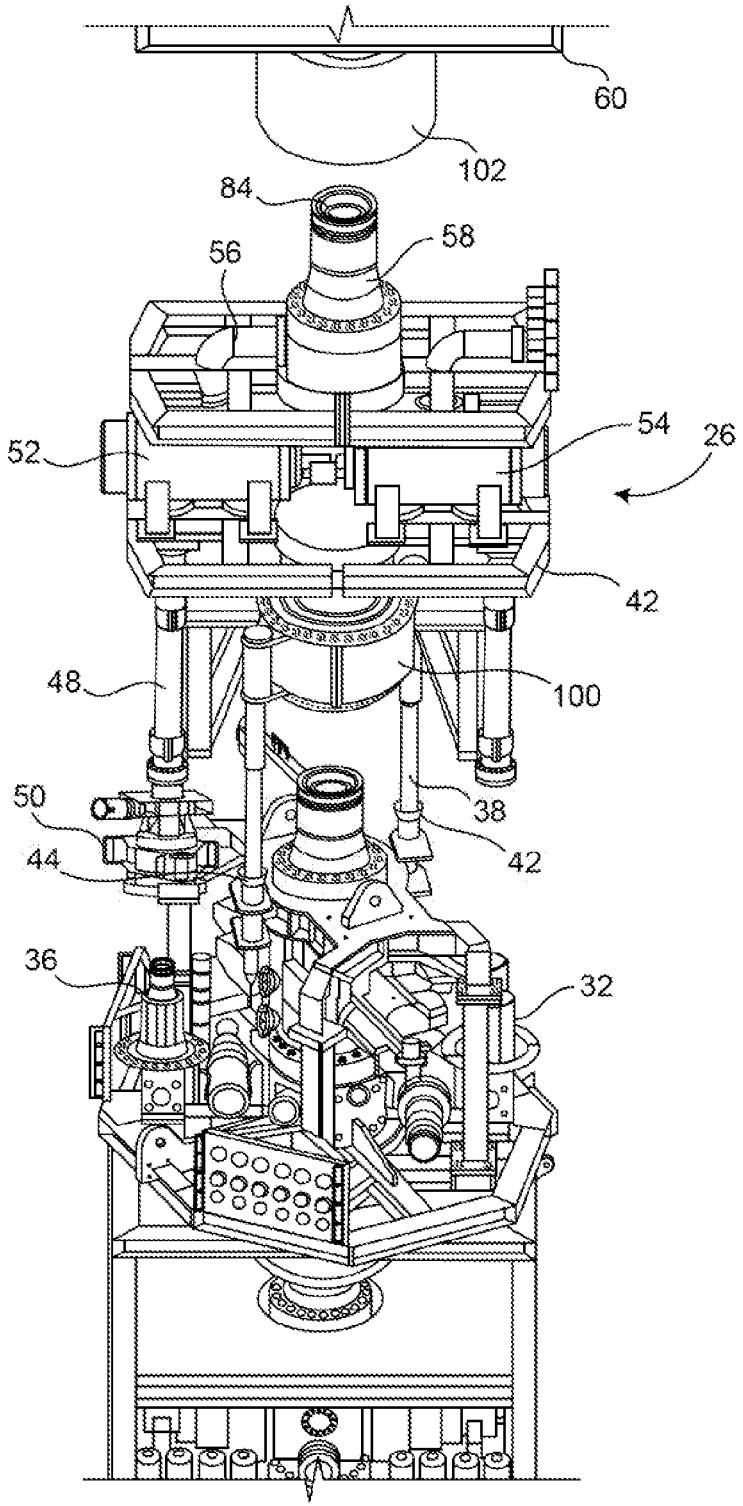
FIG. 3 is a perspective view showing the manner in which the pump module can be received by a capping stack associated with a blowout preventer.

FIG. 3 is a illustration of the pump module 26 is mated with the capping stack 32. As can be seen, the capping stack 32 has a first funnel 42 extending upwardly therefrom. A second funnel 44 also extends upwardly in spaced relationship to the first guide funnel 42. These guide funnels 42 and 44 serve to receive the pointed ends 88 and 90 of the first guide post 38 and the second guide post 40. In operation, the second guide post 40 is initially stabbed within the second guide funnel 44 by manipulation with an ROV. Once the second guide post 40 is installed within the second guide funnel 44, the ROV can suitably rotate the frame 42 of the pump module 26 so as to align the first guide post 38 with the first guide funnel 42. The ability to initially slide the second guide post 40 into the interior of the second guide funnel 44 allows the proper manipulation and rotary movement of the frame 42 of the pump module 26 to be established. Once the pointed end 88 of the first guide post 38 is aligned with the first guide funnel 42, the pump module 26 can further be lowered so that the guide posts 38 and 40 respectively mate within the within the guide funnels 42 and 44. As a result, the connector 50 of the pump module 26 will be aligned with the diverter line 36 of the capping stack 32. As such, a proper aligned relationship of the pump module 26 is established with respect to the capping stack 32. Additionally, the mandrel 34 of the capping stack 32 will be aligned with the receptacle 100 of the pump module 26.

The pump 52 is positioned so as to be cooperative with the flow line 48 of the pump module 26. The motor 54 is illustrated as drivingly connected to the pump 52. The outlet line 56 will extend from the pump 52 so as to be in communication with the interior 84 of the mandrel 58 located at the top of the pump module 26. As a result, the receptacle 102 of the second blowout preventer 60 can be mated therewith.

Figure 4:
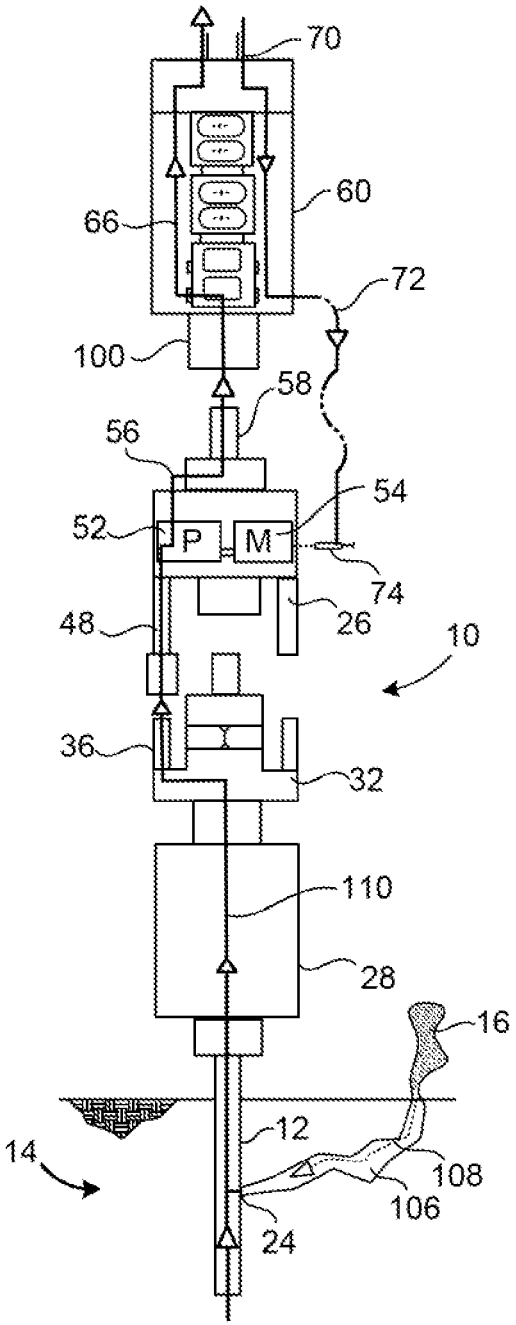
FIG. 4 is a diagrammatic illustration of the flow of fluids through the system of the present invention.

FIG. 4 shows the operation of the system 10 of the present invention. As can be seen, the pipe 12 extends into the subsea formation 14. The break 24 in the pipe 12 creates an opening to the fracture 106 in the subsea formation 14. Arrow 108 illustrates the result of negative pressure created in the subsea formation 14 by the pump module 26.

The hydrocarbons 16 will flow through the fracture 106 back into the break 24 of the pipe 12. The hydrocarbon flow 110 then passes through the interior of the blowout preventer 28 and upwardly therethough. The capping stack (or flow diverter) 32 is mounted onto the top of the first blowout preventer 28. As a result, the flow 110 of the hydrocarbon will be diverted from the main fluid passageway of the capping stack 32 through the diverter line 36. Ultimately, this flow 110 will enter the flow line 48 of the pump module 26. Pump 52 creates the requisite pressure so as to draw the hydrocarbons in the direction of the flow 110. Ultimately, the flow from the pump 20 will pass through the outlet line 56 and flow through the mandrel 58 of the pump module 26.

The flow 110 will enter the receptacle 100 of the second blowout preventer 60. The rams of the second blowout preventer is suitably closed so as to divert the flow from the main passageway of the second blowout preventer 60 through the choke line 66. Ultimately, the hydrocarbons from the fracture 106 of the formation 14 will flow outwardly therefrom and back to the surface through the choke line 66.

In the present invention, the kill line 70 is utilized so as to deliver a liquid therethrough toward the motor 54 of the pump module 26. Since the rams of the second blowout preventer 60 are suitably closed, the flow of the hydrocarbons through the kill line 70 will divert from the main flow passageway of the second blowout preventer 60. Ultimately, this flow pass through the conduit 72 so as to be introduced for the powering of the motor 54. The hot stab 74 can be installed in the motor 54 by a suitable ROV.

Ultimately, this flow will reduce or prevent the release of hydrocarbons from the fracture 106. The environmental damage caused by the release of such hydrocarbons is effectively reduced or eliminated by the system 10 of the present invention. Each of the components associated with the system 10 can be easily installed by use of an ROV and suitable hoist lines. The present invention is able to prevent this release for a significant period of time until a relief well can be installed so as to further remove the hydrocarbons from the subsea formation 14.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A system for diverting hydrocarbons gushing uncontrollably from a fracture in the earth above a subsea formation as a result of a blowout, the system comprising:

a pipe extending into the subsea formation, said pipe having a break therein so as to open to the fracture in the earth;

a first blowout preventer affixed to said pipe, said first blowout preventer having a flow passageway therein, said flow passageway being in fluid communication with said pipe;

a capping stack affixed to said first blowout preventer, said capping stack having a diverter line, said capping stack having a flow passageway therein in valved communication with said flow passageway of said first blowout preventer, said diverter line in valved communication with said flow passageway of said capping stack such that fluid can flow outwardly of said capping stack through said diverter line;

a pump module having a flow line affixed to said diverter line of said capping stack, said pump module cooperative with said diverter line of said capping stack so as to create a positive pressure to the hydrocarbons in said flow line, said positive pressure being greater than a pressure in the subsea formation; and an outlet line interconnected to said flow line of said pump module, said pump module suitable for passing the hydrocarbons from said flow line of said pump module through said outlet line;

a second blowout preventer affixed to said capping stack, said flow line of said pump module being in fluid communication with a flow passageway of said second blowout preventer, said outlet line communicating with said flow passageway of said second blowout preventer, said second blowout preventer affixed to an end of said capping stack opposite said first blowout preventer.

2. The system of claim 1, said outlet line being a choke-and-kill line connected to said second blowout preventer.

3. The system of claim 1, said pump module comprising:

a frame;

a pump affixed to said frame; and a motor operatively connected to said pump so as to drive said pump.

4. The system of claim 3, further comprising:

a connector affixed to said flow line of said pump module, said connector connected to said diverter line of said capping stack.

5. The system of claim 3, said motor being a hydraulic motor, the system further comprising:

a hydraulic line affixed to said hydraulic motor so as to pass a liquid through said hydraulic motor so as to drive said motor.

6. The system of claim 1, said capping stack having a guide funnel at an upper end thereof, said pump module having a guide post slidably received in said guide funnel of said flow diverter so as to align said flow line of said pump module with said diverter line of said capping stack.

7. The system of claim 6, said guide funnel of said capping stack comprising a first guide funnel and a second guide funnel in spaced relationship to said first guide funnel, said guide post of said pump module comprising a first guide post received in said first guide funnel and a second guide post received in said second guide funnel.

8. The system of claim 7, said first guide post having a length shorter than a length of said second guide post.

9. The system of claim 1, the subsea formation having a fluid pressure below a sea floor, said pump module creating a positive pressure greater than the fluid pressure of the subsea formation.

10. A system for diverting hydrocarbons gushing uncontrollably as a result of a blowout from a fracture in the earth above a subsea formation, the system comprising:

a pipe extending into the subsea formation, said pipe having a break therein so as to open to the fracture in the earth;

a first blowout preventer affixed to said pipe, said first blowout preventer having a flow passageway therein, said flow passageway being in fluid communication with said pipe;

a capping stack affixed to said first blowout preventer, said capping stack having a diverter line, said capping stack having a flow passageway therein in valved communication with said flow passageway of said first blowout preventer, said diverter line in valved communication with said flow passageway of said capping stack such that fluids can flow outwardly of said capping stack through said diverter line;

a pump module having a flow line affixed to said diverter line of said capping stack, said pump module cooperative with said diverter line of said capping stack so as to create a positive pressure of greater than a pressure of the subsea formation to the hydrocarbons in said flow line; and an outlet line interconnected to said flow line of said pump module, said pump module adapted to pass the hydrocarbons from said flow line to said pump module through said outlet line.

* * * * *